United States Patent [19]

Bradford

[11] 4,037,783

[45] July 26, 1977

[54] REDUCED OUTSIDE AIR CAPABILITY FOR UNIT VENTILATORS

[75] Inventor: George J. Bradford, York, Pa.

[73] Assignee: International Telephone and Telegraph Corporation, Nutley, N.J.

[21] Appl. No.: 659,400

[22] Filed: Feb. 19, 1976

[51] Int. Cl.[2] ..... F24F 7/00

[52] U.S. Cl. ..... 236/49; 165/16

[58] Field of Search ..... 236/91 D, 91 G, 49; 237/48, 53; 165/16, 28

[56] References Cited

U.S. PATENT DOCUMENTS

| | | | |
|---|---|---|---|
| 3,887,127 | 6/1975 | Jauss | 165/16 |
| 3,967,780 | 7/1976 | Traver | 236/91 |
| 3,979,922 | 9/1976 | Shavit | 165/16 |

*Primary Examiner*—William Wayner

*Assistant Examiner*—Robert J. Charvat

*Attorney, Agent, or Firm*—John T. O'Halloran; Peter C. Van Der Sluys

[57] ABSTRACT

A unit ventilator includes a means for selecting a minimum volume of fresh air to be delivered to a room in accordance with governmental ventilation codes. A control means is responsive to the selecting means and adjusts an outside air damper to achieve the minimum volume of fresh air selected. An outside air temperature sensor provides a signal corresponding to outside air temperature. The damper control means is responsive to said signal for reducing the volume of outside air admitted to the ventilator in corresponding relation to the outside air temperature so that the volume of fresh air delivered to the room is maintained substantially constant.

20 Claims, 2 Drawing Figures

REDUCED OUTSIDE AIR CAPABILITY FOR UNIT VENTILATORS

BACKGROUND OF THE INVENTION

1. Field of the Invention

The present invention relates to the control of ventilation air in heating, ventilating and air-conditioning systems and more particularly to a system whereby the volume of outside air heated by the system is reduced as the outside temperature drops.

2. Description of the Prior Art

In heating, ventilating and air-conditioning systems, it has become a normal practice to introduce at least a minimum volume of fresh air into an occupied room for ventilation purposes. This practice assures that in recirculation type systems the air being discharged into a room contains a minimum percentage of fresh air with the remaining air being recirculated air from the room. This practice is so desirable that many governmental agencies have established ventilating codes requiring that a certain percentage of the air being discharged into an occupied room be fresh air. In order to conform to these ventilation codes, prior art heating, ventilating and air-conditioning systems set the outside and recirculation air dampers so that the dampers could not be moved to a position that would allow less than the minimum code requirement of fresh air when the system was in operation.

While providing a minimum volume of fresh air is desirable, the cost of operating such a system is rapidly becoming prohibitive during cold winter weather. The outside air must be heated to the discharge air temperature and on cold days, the energy required to heat the outside air to discharge air temperature is a large percentage of the total energy required for heating a room. Thus, any excess outside air that is heated and discharged into the room becomes a major source of wasted energy which, in turn, results in higher operating costs. Thus, the prior art devices have allowed the outside air dampers to close to the minimum position to meet code requirements without any further control over the damper operation.

The prior art devices have ignored the important Charles Law relationship between air volume and temperature. By ignoring this relationship a significant waste of energy is experienced since an excess volume of outside air is heated to discharge air temperature. As the outside air is heated from low outdoor air temperatures to the discharge air temperature, the volume is significantly increased and the volume increase gets larger as the outdoor temperature drops. Thus, less outside air is required at low temperatures than at higher temperatures in order to achieve a constant volume or percentage of fresh air being discharged into the room.

As an example, consider a heating and ventilating system that provides 1000 cubic feet per minute of discharge air at a temperature of 70° F and a minimum of 25% fresh air. Each minute 250 cubic feet of outside air is drawn into the system and heated to 70° F. If the outside air temperature is 0° F, the 250 cubic feet of outside air will increase to 300 cubic feet during the temperature rise to 70° F. Thus, 50 extra cubic feet of air is heated from 0° to 70° F during each minute of operation or an extra 72,000 cubic feet of air is heated per day. Thus, it is clear that a substantial waste of energy is experienced by the prior art devices.

SUMMARY OF THE INVENTION

The present invention contemplates a heating, ventilating or airconditioning system wherein the minimum code requirements for fresh air are maintained while the outside air admitted to the system is reduced in corresponding relationship to a reduction in outside temperature. By reducing the amount of outside air drawn into the system in corresponding relationship to a reduction in outdoor temperature, only the required minimum amount of fresh air will be provided in the discharge air, thereby saving a substantial amount of energy during cold weather operations.

The primary objective of the present invention is to conserve energy in a heating and ventilating system by properly controlling the volume of outside air drawn into the system.

Another objective of the present invention is to reduce the amount of outside air drawn into a heating system in accordance with the outside air temperature.

Another objective of the present invention is to provide a convenient means for selecting the minimum percentage of outside air as prescribed by local ventilation codes.

The previously mentioned objectives and other advantages will become apparent from the specification which follows, taken in conjunction with the drawings referred to therein.

DESCRIPTION OF THE INVENTION

Figure 1:
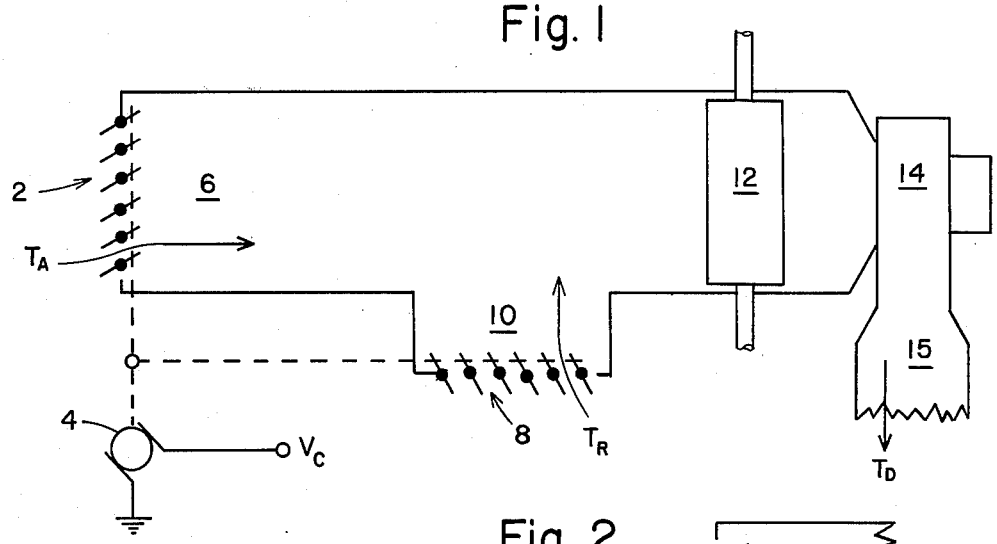
FIG. 1 shows schematically a ventilation system in which the present invention may be used.

Referring to FIG. 1, there is shown a heating and ventilating system constructed in accordance with the present invention wherein outside air dampers 2 are controlled by a damper motor 4 for admitting a controlled amount of outside air into a fresh air duct 6 of the system. The system may be of a recirculating type that has recirculation air dampers 8 also operated by motor 4 in a manner complementary to outside air dampers 2. That is to say as dampers 2 close, dampers 8 open. Dampers 8 admit room air into a recirculating air duct 10. The outside air and recirculating air are drawn through a heating means 12 by a blower 14 where the combined air is heated to the desired temperature and thereafter discharged to the room through a duct 15.

Thus, outside air is drawn through dampers 2 at ambient temperature of $T_A$ while recirculating air is drawn through dampers 8 at a temperature of $T_R$ and the combined air is discharged through duct 15 at a temperature of $T_D$.

Damper motor 4 is adapted to receive a control signal $V_C$ for operating said motor and driving the dampers.

Figure 2:
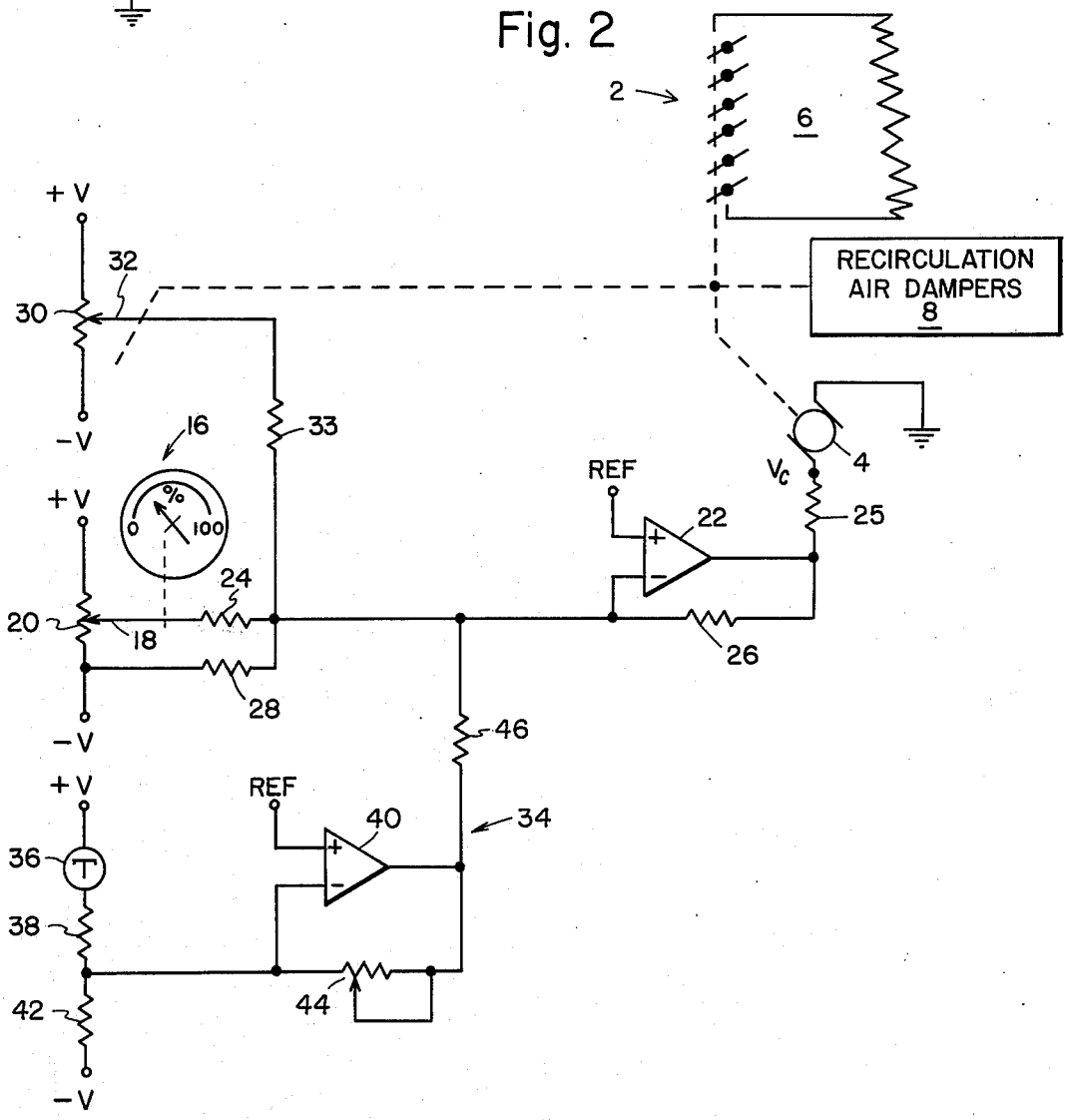
FIG. 2 is a schematic diagram of a control system constructed in accordance with the present invention.

Control signal $V_C$ is provided by a control circuit as shown in FIG. 2 where there is shown a means 16 for selecting a minimum percentage or volume of fresh discharge air as required by the local ventilation code. The selecting means 16 is connected to the wiper arm 18 of a potentiometer 20. Potentiometer 20 is connected between positive +V and negative −V potentials. The wiper arm 18 of potentiometer 20 is connected to an inverting input of an operational amplifier 22 through a resistor 24. Operational amplifier 22 is a standard operational amplifier and has a non-inverting input connected to a reference signal which may be zero volts. A resistor 26 is connected from the output of the operational amplifier 22 to the inverting input for providing negative feedback. A resistor 28 is connected from the negative $-V$ potential to the inverting input of amplifier 22.

A feedback potentiometer 30 is connected between positive $+V$ and negative $-V$ potentials and has a wiper arm 32 which is connected to the inverting input of operational amplifier 22 through a resistor 33.

The output of amplifier 22 is connected to the damper control motor 4 through a resistor 25 for providing a motor control signal $V_C$ thereto. As previously mentioned motor 4 is connected to drive dampers 2 and 8 in a complementary manner. Wiper arm 32 of potentiometer 30 is drivably connected to the motor so that the signal appearing at the wiper corresponds to the damper position and completes the damper motor control loop.

Operation of the circuit as thus far described is that of a standard servo loop wherein the required minimum percentage or volume of fresh air is set by adjusting means 16 which positions the wiper arm 18 of potentiometer 20 at a particular position to provide a voltage to the inverting input of amplifier 22. The voltage from potentiometer 20 causes the amplifier 22 to provide a control signal $V_C$ to the damper motor 4 which drives damper 2 and 8 and the wiper arm 32 of potentiometer 30 to a position in which the voltage on the wiper arm 32 cancels out the voltage on wiper arm 18 and the system is stabilized at the desired setting of adjusting means 16.

Reduced outside air capability is provided by the additional control circuit 34 which provides a reset signal to the inverting input of operational amplifier 22 and causes the motor 4 to drive the dampers and wiper arm 32 to a new position in which the reset signal is balanced by a change in the signal from potentiometer 30.

Considering now the details of the circuit 34. A temperature sensor 36 is connected in series with a resistor 38 and the series connection is connected between a positive $+V$ potential and an inverting input of an operational amplifier 40. Operational amplifier 40 is a standard operational amplifier and has a non-inverting input connected to a reference signal which may be zero volts. A resistor 42 is connected between a negative $-V$ potential and the inverting input of amplifier 40 and a variable resistor 44 is connected between the output of amplifier 40 and the inverting input for providing an adjustable amount of negative feedback thereto.

The temperature sensor 36 is mounted in a location where it senses outdoor ambient temperature and may be a thermistor having a negative temperature coefficient so that the resistance of the thermistor increases as the temperature to which it is exposed decreases. It is to be understood that other types of temperature sensors could readily be used with the present invention, such as other sensors that provide a variable resistance corresponding to the sensed temperature or active solid state temperature sensors that provide a voltage or current output corresponding to temperature. Many thermistors have non-linear resistance characteristics; therefore, resistor 38 is selected to provide a first order of linearization, thereby making the signal at the inverting input of amplifier 40 substantially linear over a range of at least 60° F. It may be desirable that resistors 38, 42 and thermistor 36 be selected so that a zero voltage is seen at the inverting input of amplifier 40 when the outdoor temperature is approximately 60° F so that a linear output is provided over the approximate range of between 60° F and 0° F.

The adjustable resistor 44 is set to provide a predetermined number of volts per degree change in outside ambient temperature so that a reset signal is provided to inverting input of amplifier 22 through a resistor 46. The characteristics of potentiometer 30, the setting of adjustable resistor 44 and the resistances of resistors 33 and 46 must all be selected so that the change in temperature and the reduction in damper opening will be linear.

Thus, during initial installation of the control system, the local code requirement for minimum percentage of volume of fresh air will be set into potentiometer 20 by adjustment means 16. The adjustable resistor 44 is set to provide a corresponding reduction in outside damper opening for a reduction in outside temperature. After these adjustments are made, the system will automatically reduce the amount of outside air drawn into the system in accordance with a reduction in outside temperature in a manner that follows Charles Law which, when reduced to its simplest form, states that volume = $Kt_{absolute}$. Since the volume of a pound of denser cold outdoor air is decreased, the system automatically reduces the volume of such air that is drawn into the system so that when the reduced volume of outside air is heated to the desired discharge temperature, the volume of fresh air will be sufficient to satisfy the ventilation code requirements.

Thus, it is clear that the present invention reduces energy consumption and improves efficiency by eliminating the wasteful heating of excess outdoor air as resulted in the prior art devices. The present invention also provides a convenient means for selecting the minimum volume or percentage of outside air as required by local codes which vary considerably from municipality to municipality. Thus, a standard heating, ventilating or airconditioning system may be provided that is easily adjusted to meet local code requirements.

The invention is clearly applicable to all types of hot air heating systems where outside air is drawn into the system for ventilation purposes. The outside air may be mixed with return air and then heated or the system may be of a type that only heats outside air and is required to discharge a predetermined volume of the heated outside air. In either case the invention saves substantial amounts of energy and thereby reduces heating costs.

In a more sophisticated embodiment, it may be desirable to provide a second reset signal to the inverting input of amplifier 22 to adjust for variations in return air temperature from the room; however, it is felt that for most applications, such a refinement would not be necessary.

Thus, the present invention clearly conserves energy in a heating and ventilating system by properly controlling the volume of outside air drawn into the system so that local ventilation code requirements are met with heating excess outside air. The invention achieves this result by reducing the volume of outside air drawn into the system in corresponding relation to a reduction in outside air temperature.

The invention has been described in terms of air volume control by controlling the damper opening because this relationship is easy to visualize. However, it is to be understood that the invention also applies to the control of the weight of the air admitted to a system. When air is heated the volume increases but the weight remains constant. For a constant weight of fresh outdoor air, the damper 2 must close down to reduce the volume of fresh outdoor air admitted as the outdoor air temperature decreases. Thus, it may be said that an objective of the invention is to deliver a constant weight of outdoor air per minute and the potentiometer 20 is set by adjusting means 16 to provide a signal corresponding to a minimum weight of outdoor air to be delivered.

While the principles of this invention have been described above in connection with a specific apparatus, it is to be understood that this description is made only by way of example and not as a limitation on the scope of the invention as set forth in the accompanying claims.

What is claimed is:

1. A ventilation apparatus, comprising:

means for delivering tempered outdoor air to a room; and means for controlling the volume of outdoor air that is tempered in corresponding relation to outdoor air temperature so that the volume of tempered outdoor air delivered to the room remains substantially constant over variations in outdoor temperature.

2. A ventilation apparatus, comprising:

means for heating outdoor air and delivering the fresh heated air to a room; and means for controlling the volume of outdoor air that is heated in corresponding relation to the outdoor air temperature so that the volume of fresh heated air delivered to the room remains substantially constant.

3. A ventilation apparatus as described in claim 2, additionally comprising means for selecting the volume of fresh heated air to be delivered to the room.

4. A ventilation apparatus as described in claim 2, wherein the means for controlling the volume of outdoor air that is heated, comprises:

an outdoor air damper;

means for sensing outdoor air temperature and providing a signal corresponding thereto; and means responsive to the signal for positioning the outdoor air damper in response to said outdoor air temperature signal.

5. A ventilation apparatus as described in claim 2, additionally comprising means for selecting a volume of fresh heated air to be delivered to the room and for providing a signal corresponding thereto, said controlling means including an outdoor air damper responsive to the signal and means for modifying said signal in accordance with outdoor air temperature.

6. A ventilation apparatus, comprising:

means for discharging air at a substantially constant discharge temperature, said discharged air containing a percentage of fresh outdoor air; and means for controlling the volume of outdoor air admitted to the discharging means in corresponding relationship to the outdoor air temperature so that the percentage of fresh outdoor air contained in the discharged air remains substantially constant.

7. A ventilation apparatus as described in claim 6, additionally comprising means for selecting and controlling the percentage of fresh outdoor air contained in the discharge air.

8. A ventilation apparatus as described in claim 6, wherein the means for controlling the volume of outdoor air admitted to the discharging means comprises:

an outdoor air damper; and means for controlling said damper in corresponding relationship to the outdoor air temperature.

9. A ventilation apparatus as described in claim 6, additionally comprising:

means for selecting a percentage of fresh outdoor air to be contained in the discharge air and for providing a percentage signal corresponding thereto;

said means for controlling the volume of outdoor air admitted to the discharging means, comprises an outdoor air damper responsive to the percentage signal; and means for modifying said percentage signal in accordance with outdoor air temperature.

10. A ventilation apparatus, comprising:

means for delivering air at a predetermined temperature, said delivered air containing a portion of fresh air and a portion of recirculated air;

means for selecting a percentage of delivered air that should be fresh air;

means responsive to said selecting means for controlling the mixture of fresh air and recirculated air; and means for controlling the volume of outdoor air admitted to the air delivering means in corresponding relation to the outdoor air temperature so that the percentage of fresh air in the delivered air remains substantially constant during variations in outdoor air temperature.

11. A ventilation apparatus, comprising:

means delivering heated outdoor and recirculated air to a room;

means for selecting a percentage of heated outdoor air to be contained in the delivered air and for providing a signal corresponding thereto;

means for sensing outdoor air temperature and providing a signal corresponding thereto;

means responsive to said signals for controlling the volumes of outdoor air and recirculated air that are heated so that the selected percentage of heated outdoor air contained in the delivered air remains substantially constant.

12. A unit ventilator of the type that delivers conditioned air to a room, said conditioned air containing a minimum percentage of fresh air, wherein the improvement comprises means for decreasing the volume of outdoor air admitted to the unit in corresponding relation to the outdoor air temperature, whereby the percentage of fresh air delivered remains substantially constant despite variations in outdoor air temperature.

13. A damper control system for a ventilating apparatus, comprising:

means for providing a signal corresponding to a volume of air to be delivered; and means responsive to outdoor air temperature for modifying said signal in corresponding relation to the outdoor air temperature to provide a damper control signal.

14. A control system as described in claim 13, additionally comprising means for selecting the volume of air to be delivered.

15. A system as described in claim 13, wherein the means for modifying said signal comprises:

means for sensing outdoor air temperature and providing a signal corresponding thereto; and means responsive to said volume signal and said temperature signal for providing the damper control signal in response thereto.

16. A damper control system for a ventilating apparatus, comprising:

means for providing a signal corresponding to a percentage of fresh air to be contained in delivered air;

means for sensing ambient temperature and for providing a signal corresponding thereto; and means responsive to said signals for providing a damper control signal to said ventilating apparatus, whereby the damper opening may be reduced in corresponding relation to ambient temperature and the percentage of fresh air delivered maintained substantially constant.

17. A control system as described in claim 16, wherein the means for providing the percentage signal comprises a potentiometer providing an electrical signal and the means responsive to ambient temperature comprises a temperature sensor for providing an electrical signal corresponding to the ambient temperature; and the means responsive to said signals comprises an operational amplifier.

18. A control circuit for an outdoor air damper of a ventilating system, comprising:

means for providing a damper position signal corresponding to a damper opening required to deliver a first volume of outdoor air at a first outdoor air temperature;

means responsive to outdoor air temperature for providing a damper reset signal; and means responsive to said damper position signal and said damper reset signal for providing a damper control signal that varies in corresponding relation to the outdoor air temperature so that a damper opening may be controlled to deliver a second volume of outdoor air at a second outdoor air temperature, the ratio of said first and second volumes corresponding to the ratio of said first and second temperatures.

19. A control circuit for an outdoor air damper of a ventilating system, comprising:

means for providing a damper position signal corresponding to a minimum weight of outdoor air to be delivered at a first temperature;

means responsive to outdoor air temperature for providing a damper reset signal; and means responsive to said damper position signal and said damper reset signal for providing a damper control signal that varies in corresponding relation to the outdoor air temperature so that the damper opening may be controlled to deliver a substantially constant weight of outdoor air as the outdoor air temperature varies.

20. A ventilating apparatus, comprising:

means for heating and delivering outdoor air to a room;

means for controlling the weight of outdoor air that is heated in corresponding relation to outdoor air temperature so that the weight of outdoor air delivered to the room remains substantially constant at varying outdoor air temperatures.

* * * * *